US008134299B2

(12) United States Patent
Peng

(10) Patent No.: US 8,134,299 B2
(45) Date of Patent: Mar. 13, 2012

(54) LED CONTROL SYSTEM USING MODULATED SIGNAL

(75) Inventor: Wen-Chi Peng, Jhonghe (TW)

(73) Assignee: Semisilicon Technology Corp., Taipei County (TW)

( * ) Notice: Subject to any disclaimer, the term of this patent is extended or adjusted under 35 U.S.C. 154(b) by 426 days.

(21) Appl. No.: 12/499,276

(22) Filed: Jul. 8, 2009

(65) Prior Publication Data

US 2010/0013396 A1 Jan. 21, 2010

(30) Foreign Application Priority Data

Jul. 15, 2008 (TW) ..... 97126765 A
May 5, 2009 (TW) ..... 98114815 A

(51) Int. Cl.
*H05B 37/02* (2006.01)

(52) U.S. Cl. ..... 315/192; 315/318

(58) Field of Classification Search ..... 315/192, 315/224, 250, 254, 246, 312, 317, 318, 319
See application file for complete search history.

(56) References Cited

U.S. PATENT DOCUMENTS 7,961,113 B2 * 6/2011 Rabiner et al. ..... 340/4.21
2006/0022616 A1 * 2/2006 Furukawa et al. ..... 315/309
2009/0021178 A1 * 1/2009 Furukawa et al. ..... 315/250

* cited by examiner

*Primary Examiner* — Daniel D Chang
(74) *Attorney, Agent, or Firm* — Chun-Ming Shih; HDLS IPR Services

(57) ABSTRACT

An LED control system using a modulated signal includes a computer, a data storage unit, an AC power, a power conversion circuit, a control circuit, and an LED lamp string. The AC power is converted into a DC power by the power conversion circuit to supply a DC voltage to the control circuit and the LED lamp string. A computer control data is sent to the control circuit through the data storage unit by a user using the computer. The computer control data is modulated to a modulated signal by the control circuit. The modulated signal is sent to the LED lamp string with the same transmission line sending the DC voltage. The light of the LED lamp string is changed according to the modulated signal. The cost is reduced because the DC voltage and the modulated signal are sent in the same transmission line.

8 Claims, 7 Drawing Sheets

LED CONTROL SYSTEM USING MODULATED SIGNAL

BACKGROUND OF THE INVENTION

1. Field of the Invention

The present invention relates to an LED control system, and more particularly to an LED control system using a modulated signal.

2. Description of Prior Art

Nowadays, the connection way of the LED lamp string modules is separated into two types: serial-type connection and parallel-type connection. The LED lamp string modules are widely used for decoration of trees, scenery designing, signboard, external walls of the building, and so on, because of small size, long life, low power, rapid response, and strong shake-proof property for the LEDs.

The prior art LED lamp string modules are commonly employed to be connected in series. Also, the amount of the LED lamp string modules is determined according to volume of the decorated objects. In addition, all of the LED lamp string modules are controlled by the same controller which initially controls the first LED lamp string module. Although the LED lamp string modules are easily connected together, the remaining LED lamp string modules behind the abnormal LED lamp string module can not be lighted even only one of the LED lamp string modules is abnormal. That is because the control signal can not be sent to drive all of the remaining LED lamp string modules.

In addition, in operation the parallel-type LED lamp string modules are connected to the controller in parallel. Accordingly, each one of the LED lamp string modules is controlled by the controller through a control line and an address line, respectively. For example, ten control lines and ten address lines need to be used when ten LED lamp string modules are employed to be connected in parallel. Also, the remaining LED lamp string modules can still be normally controlled when one of the LED lamp string modules is abnormal. However, the amount of the control lines and the address lines increase proportionally. Therefore, complexity and costs of the equipment also increase when the amount of the LED lamp string modules increases.

Now matter the connection way of the LED lamp string modules is serial-type or parallel-type, many power transmission lines and signal transmission lines need to be used to control the color and intensity of the LED lamp string modules. Accordingly, cost down can be achieved only if the amount of the power transmission lines or the signal transmission lines can be reduced.

SUMMARY OF THE INVENTION

Accordingly, an LED control system using a modulated signal is provided to reduce the use of the transmission lines and save the costs.

In order to achieve the objectives mentioned above, the LED control system using a modulated signal is provided to store a computer control data in a data storage unit, and a data signal outputted from the data storage unit is used to control the color and intensity of the LEDs. The LED control system includes a power conversion, a control circuit, and a plurality of LED emission circuits. The power conversion circuit is provided to convert an AC power into a DC power. The control circuit is electrically connected to the power conversion circuit to receive the DC power outputted from the power conversion circuit and the data signal outputted from the data storage unit, and to modulate the data signal to a modulated signal. The LED emission circuits are electrically connected in series to the control circuit through a transmission line to receive the DC power outputted from the control circuit and the modulated signal to vary the color and intensity of the LEDs.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
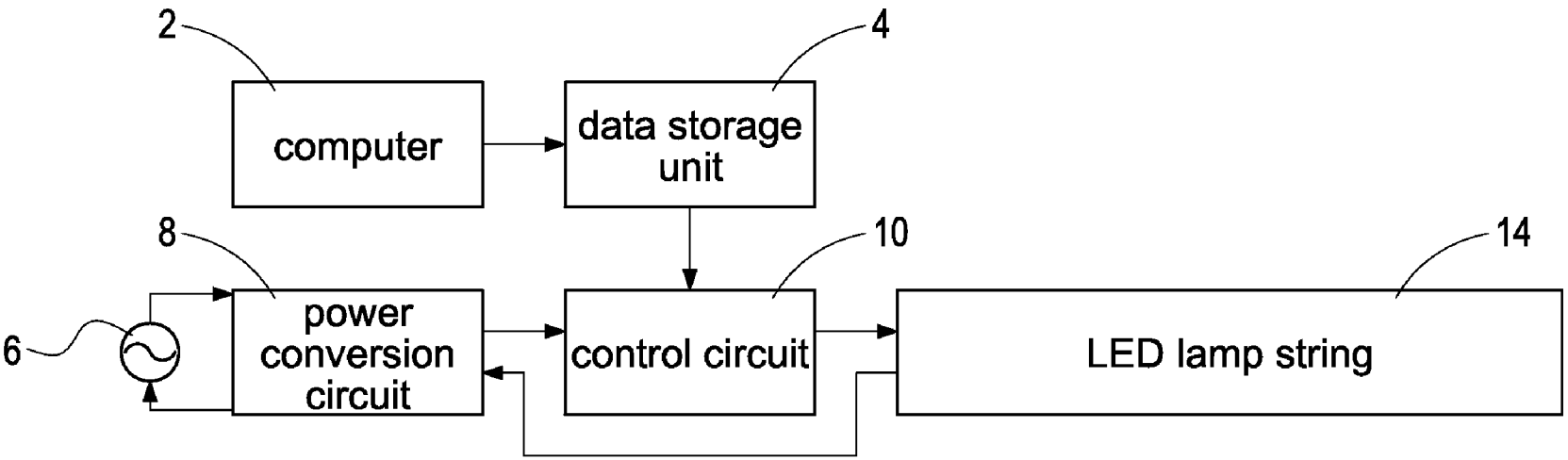
FIG. 1 is a block diagram of an LED control system using a modulated signal according to the present invention.

Reference will now be made to the drawing figures to describe the present invention in detail. FIG. 1 is a block diagram of an LED control system using a modulated signal according to the present invention. The LED control system includes a computer 2, a data storage unit 4, an AC power 6, a power conversion circuit 8, a control circuit 10, and an LED lamp string 14. The computer 2 is electrically connected to the data storage unit 4. The AC power 6 is electrically connected to the power conversion circuit 8. The control circuit 10 is electrically connected to the data storage unit 4, the power conversion circuit 8, and the LED lamp string 14, respectively. The operational procedure of this embodiment is as follows. First, a computer control data is stored in the data storage unit 4 by the computer 2, and the computer control data is sent to the control circuit 10 through the data storage unit 4 to control the color and intensity of the LED lamp string 14. A data signal is sent to the control circuit 10 by the data storage unit 4. Also, the control circuit 10 modulates the data signal into a modulated signal, and the modulated signal is advantageous for signal transmission. The power conversion circuit 8 converts the AC power 6 (such as a 110-volt utility power) into a DC power (such as a 110-volt DC power) after the power conversion circuit 8 receives the AC power 6. Also, the DC power is provided to drive the control circuit 10 and the LED lamp string 14 with the same transmission line that is used to send the modulated signal to the LED lamp string 14.

Figure 2:
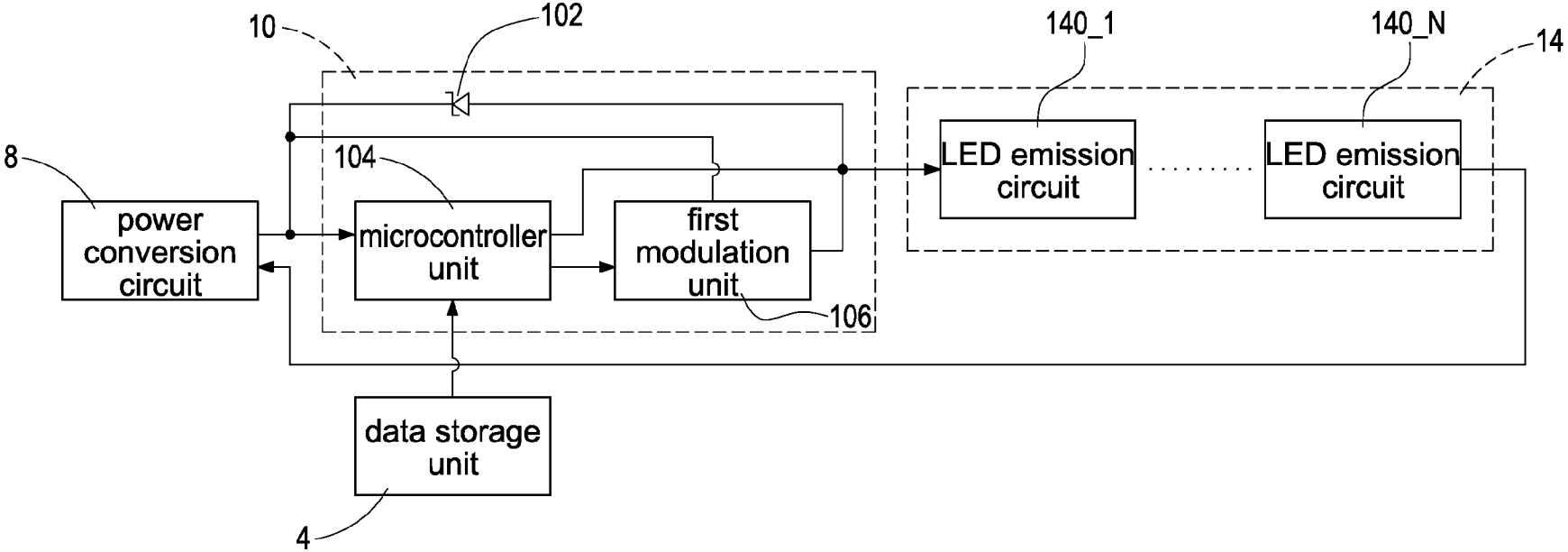
FIG. 2 is an internal block diagram of a control circuit and an LED lamp string.

Reference is made to FIG. 2 which is an internal block diagram of a control circuit and an LED lamp string. The control circuit 10 includes a voltage stabilizer unit 102 (such as a Zener diode), a microcontroller unit 104, and a first modulation unit 106. The microcontroller unit 104 is electrically connected to the data storage unit 4, the voltage stabilizer unit 102, the power conversion circuit 8, the first modulation unit 106, and the LED lamp string 14, respectively. The first modulation unit 106 is electrically connected to the voltage stabilizer unit 102, the power conversion circuit 8, the microcontroller unit 104, and the LED lamp string 14, respectively. The LED string 14 is composed of a plurality of LED emission circuits 140_1, 140_2, . . . , 140_N. (The LED emission circuits 140_1, 140_2, . . . , 140N will be collectively represented with numeral 140 hereafter.) The LED emission circuits 140 are electrically connected in series, and one terminal of the first LED emission circuit 140_1 is electrically connected to the voltage stabilizer unit 102, the microcontroller unit 104, and the first modulation unit 106, respectively.

The operation relation between the control circuit 10 and the LED lamp string is as follows. The power conversion circuit 8 provides a high DC voltage, such as a 110-volt DC voltage. The voltage stabilizer unit 102 provides a DC voltage to drive the microcontroller unit 104 and the first modulation unit 106. The microcontroller unit 14 receives the data signal sent from the data storage unit 4. Afterward, the data signal is sent from the microcontroller unit 14 to the first modulation unit 106 to modulate the data signal to generate the modulated signal. (The detailed description is as follows.) Afterward, the modulated signal is sent to the LED lamp string 14 with the same transmission line that is used to send the DC power to the control circuit 10 and the LED lamp string 14. The first LED emission circuit 140_1 receives the DC power and the modulated signal sent from the control circuit 10 to light the corresponding LEDs. Afterward, the DC power and the modulated signal are sent to the next LED emission circuit, namely the second LED emission circuit 140_2.

Figure 3:
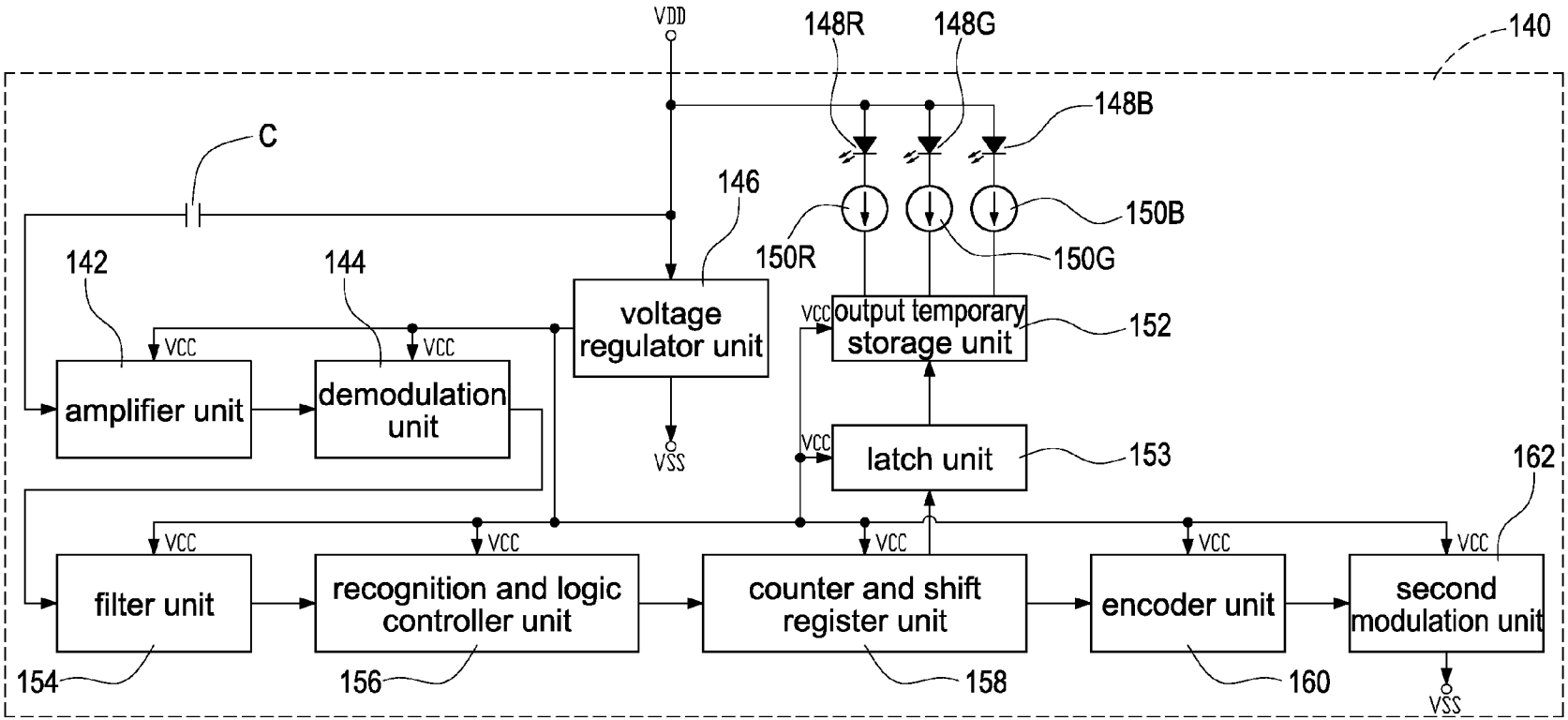
FIG. 3 is an internal block diagram of an LED emission circuit.

Reference is made to FIG. 3 which is an internal block diagram of an LED emission circuit. The LED emission circuit 140 includes a signal acquisition unit C (such as a capacitor), an amplifier unit 142, a demodulation unit 14, a voltage regulator unit 146, a red light LED 148R, a green light LED 148G, a blue light LED 148B, a first constant current source 150R, a second constant current source 150G, a third constant current source 150B, an output temporary storage unit 152, a latch unit 153, a filter unit 154, a recognition and logic controller unit 156, a counter and shift register unit 158, an encoder unit 160, and a second modulation unit 162. For the first LED emission circuit 140_1, a VDD terminal is where that the DC power and the modulated signal are sent from the control circuit 10. For the second LED emission circuit 140_2, the VDD terminal is where that the DC power and the modulated signal are sent from the first LED emission circuit 140_1. For the remaining LED emission circuits 140_3, . . . , 140_N, the VDD terminal is where that the DC power and the modulated signal are sent in analogous ways. For the first LED emission circuit 140_1, a VSS terminal is where that the DC power and the modulated signal are sent to the second LED emission circuit 140_2. For the second LED emission circuit 140_2, the VSS terminal is where that the DC power and the modulated signal are sent to the third LED emission circuit 140_3. For the remaining LED emission circuits 140_4, . . . , 140_N, the VSS terminal is where that the DC power and the modulated signal are sent in analogous ways. Namely, the VDD terminal is an input terminal and the VSS terminal is an output terminal for each of the LED emission circuits 140. In addition, a VCC terminal is where that the DC voltage outputted from the voltage regulator unit 146 and is where that the DC voltage inputted to the above-mentioned units.

For more detailed expression, the VDD terminal is electrically connected to the VSS terminal though the voltage regulator unit 146. Also, the VDD terminal is electrically connected to the amplifier unit 142 through the signal acquisition unit C. Also, the VDD terminal is electrically connected to the first constant current source 150R through the red light LED 148R. Also, the VDD terminal is electrically connected to the second constant current source 150G through the green light LED 148G Also, the VDD terminal is electrically connected to the third constant current source 150B through the blue light LED 148B. In addition, the filter unit 154 is electrically connected to the amplifier unit 142 through the demodulation unit 144. The counter and shift register unit 158 is electrically connected to the filter unit 154 through the recognition and logic controller unit 156. Also, the counter and shift register unit 158 is electrically connected to the output temporary storage unit 152 through the latch unit 153. Also, the counter and shift register unit 158 is electrically connected to the second modulation unit 162 through the encoder unit 160. In addition, the output temporary 152 is electrically connected to the first constant current source 150R, the second constant current source 150G, and the third constant current source 150B, respectively. The second modulation unit 162 is electrically connected to the VSS terminal.

The operation procedure of the LED emission circuit 140 is explained as follows. The signal acquisition unit C (such as a capacitor) blocks the DC voltage in the VDD terminal to enter into the amplifier unit 142 and other units which process the AC signals. However, the modulated signal can only pass through the signal acquisition unit C. The DC voltage in the VDD terminal is provided to the voltage regulator unit 146 to generate a DC voltage VCC2 outputted from a VCC terminal. Also, the DC voltage VCC2 is supplied to drive other units. The DC power is sent from the VSS terminal of the voltage regulator unit 146 to the VDD terminal of the next LED emission circuit 140. A DC component of the modulated signal sent from the VDD terminal is blocked by the signal acquisition unit C, and an AC component of the modulated signal is passed by the signal acquisition unit C. Afterward, the AC component of the modulated signal is amplified by the amplifier unit 142. Afterward, the amplified modulated signal (only the AC component) is demodulated by the demodulation unit 144. Afterward, the demodulated signal is restored to the original signal by the filter unit 154. Afterward, the original signal is recognized to separate the data contents and clock, and the data contents are shifted in the counter and shift register unit 158. After a number of signals are sent, the data contents of the counter and shift register unit 158 are latched to the output temporary storage unit 152 by the latch unit 153 when a defaulted end signal is received. The color and intensity of the red light LED 148R, the green light LED 148G, and the blue light 148B are performed according to the data contents. In addition, the data contents are sent to the encoder unit 160 by the counter and shift register unit 158 to be encoded. Afterward, the encoded data contents are sent to the second modulation unit 162 to be modulated into a modulated signal.

The modulated signal is sent to the next LED emission circuit 140 through the VSS terminal. More particularly, the first constant current source 150R, the second constant current source 150G, and the third constant current source 150B provide the constant current and receive the data contents outputted from the output temporary storage unit 152.

Figure 8:
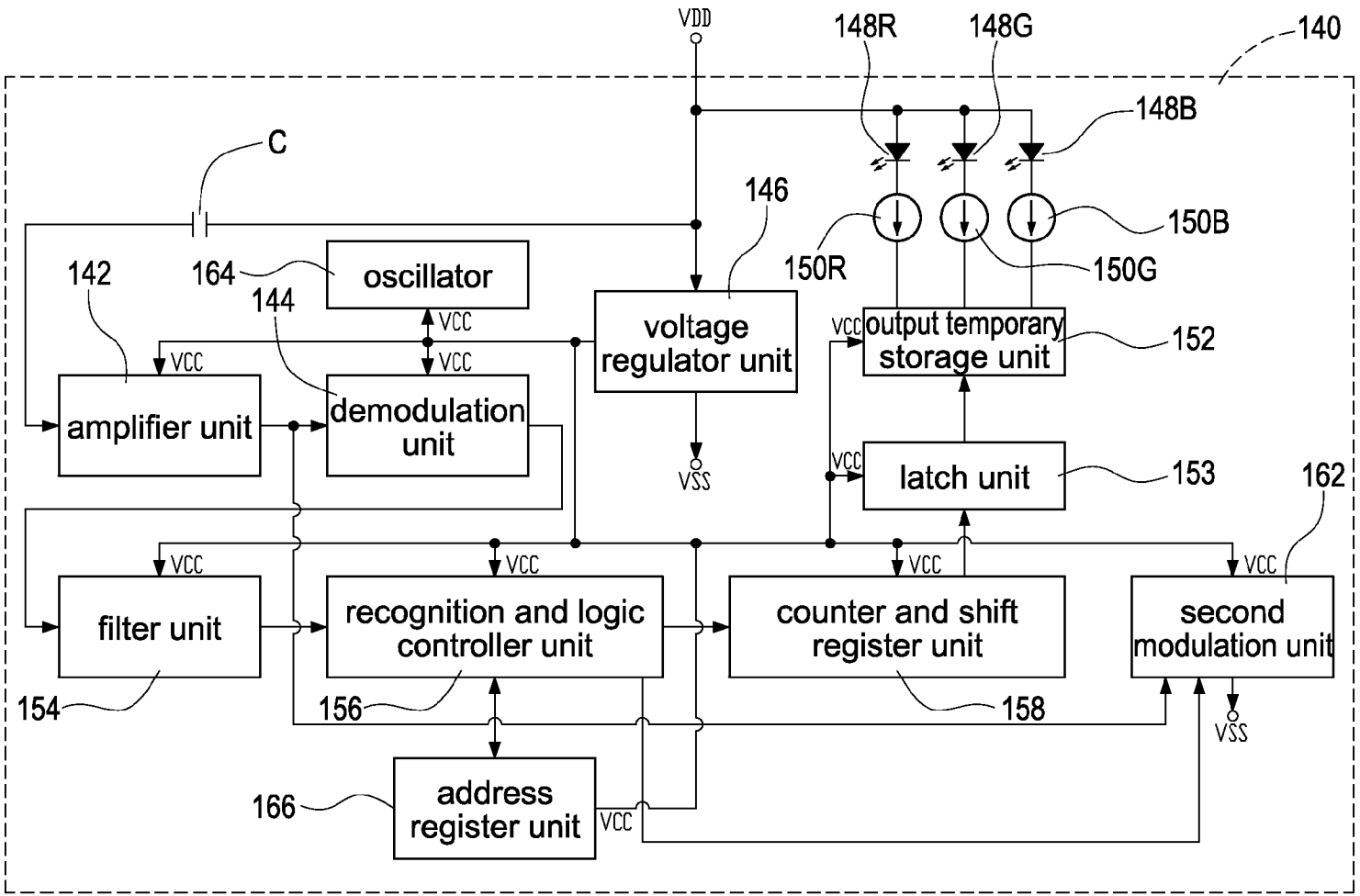
FIG. 8 is another internal block diagram of the LED emission circuit.

The above-mentioned modulation signal transmission is a serial-type modulated signal transmission. In addition, the above-mentioned modulation signal transmission can be implemented using a parallel-type modulated signal transmission. In order to implement the parallel-type modulated signal transmission, an automated numbered system is provided to assign numbers to each of the LED emission circuits 140. Hence, the received address signals are compared to the assigned numbers of the LED emission circuit 140. For example, the microcontroller unit 104 sends an address signal with number 0 to the first LED emission circuit 140_1 when the LED control system is started up. Afterward, the address signal with number 0 is stored in the first LED emission circuit 140_1 and the address signal is added by 1. Namely, the address signal with number 1 is sent from the second modulation unit 162 to the second LED emission circuit 140_2. Afterward, the address signal with number 1 is stored in the second LED emission circuit 140_2 and the address signal is added by 1. Namely, the address signal with number 2 is sent from the second modulation unit 162 to the third LED emission circuit 140_3. The address signal is processed for the remaining LED emission circuits 140_3, 140_4, . . . , 14_N in analogous ways. Finally, the address signal with number N is sent to the microcontroller unit 104. Accordingly, the microcontroller unit 104 can recognize the amount of the LED emission circuits 140, and each of the LED emission circuits 140 has been assigned numbers. FIG. 8 is another internal block diagram of the LED emission circuit. Accordingly, the modulated signal is processed by the corresponding LED emission circuits 140 based on the assigned numbers. As shown in FIG. 8, an address register unit 166 is electrically connected to the recognition and logic controller unit 16.

Figure 4:
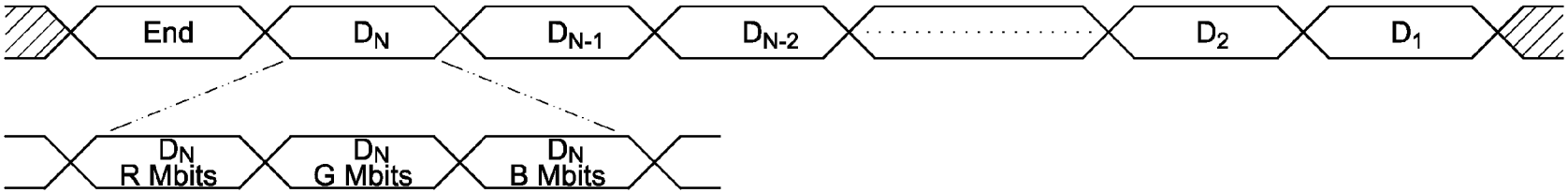
FIG. 4 is a timing sequence diagram of communicating a modulated signal between the LED emission circuits.

Reference is made to FIG. 4 which is a timing sequence diagram of communicating a modulated signal between the LED emission circuits. The lower part of the FIG. 4 shows the modulated signal which is sent to the Nth LED emission circuit 140_N. Also, the sequence of the colors is not limited as shown in FIG. 4. As mentioned above, the data contents of the counter and shift register unit 158 are latched to the output temporary storage unit 152 through the latch unit 153 to control the color and intensity of the LEDs when the defaulted end signal END is received. In the same way, the modulated signal (shown in FIG. 4) can be sent from the xth LED emission circuit 140_x to the next LED emission circuit, namely the (x+1)th LED emission circuit 140_(x+1).

Figure 5:
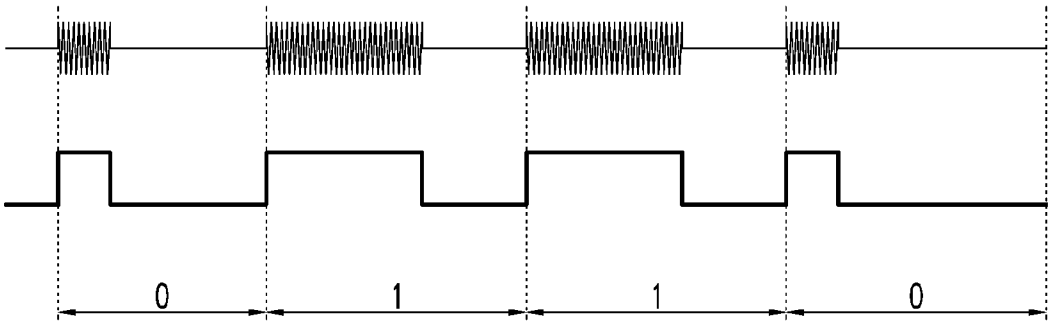
FIG. 5 is a schematic view of a modulated signal (upper part) and a data signal (lower part)
Figure 6A:
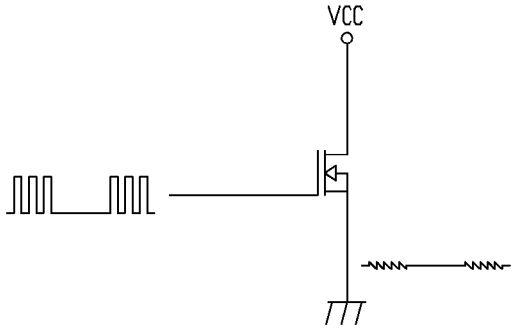
FIG. 6A is a schematic view of an embodiment of a modulation unit.
Figure 6B:
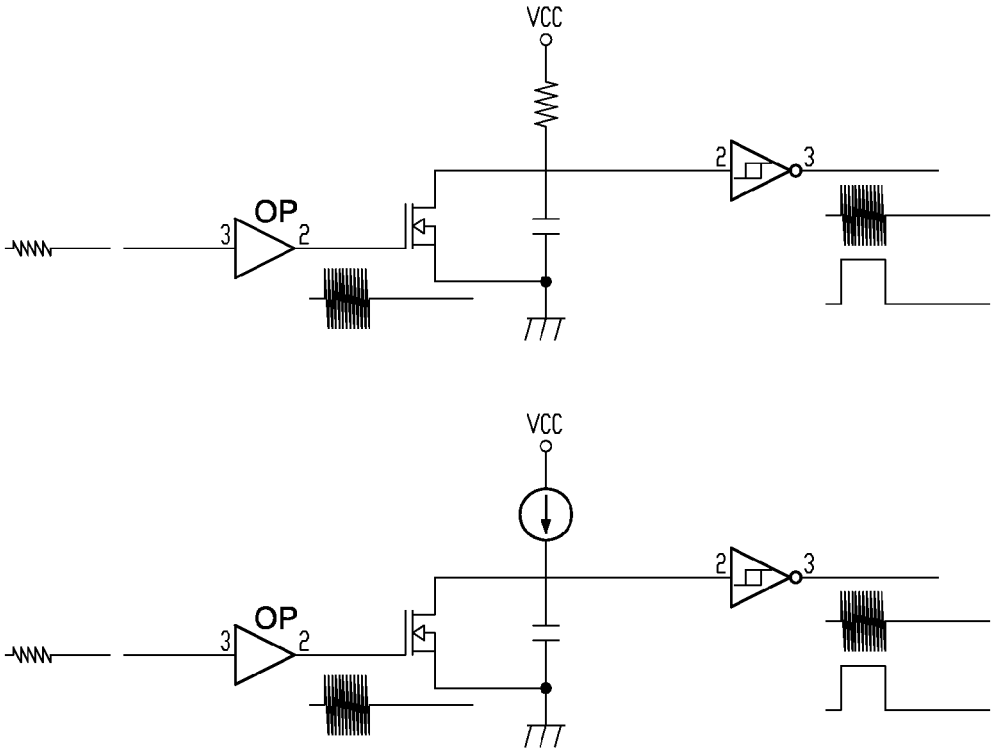
FIG. 6B is a schematic view of an embodiment of a demodulation unit.

Reference is made to FIG. 5 which is a schematic view of a modulated signal (upper part) and a data signal (lower part). A sequence (0, 1, 1, 0) of the digital signal can be sent through the pulse width modulation (PWM) scheme. Also, the data signal can be modulated to generate the modulated signal. Reference is made to FIG. 6A which is a schematic view of an embodiment of a modulation unit (such as the first modulation unit 106, and the second modulation unit 162). Also, reference is made to FIG. 6B which is a schematic view of an embodiment of a demodulation unit (such as the demodulation unit 144).

Figure 7:
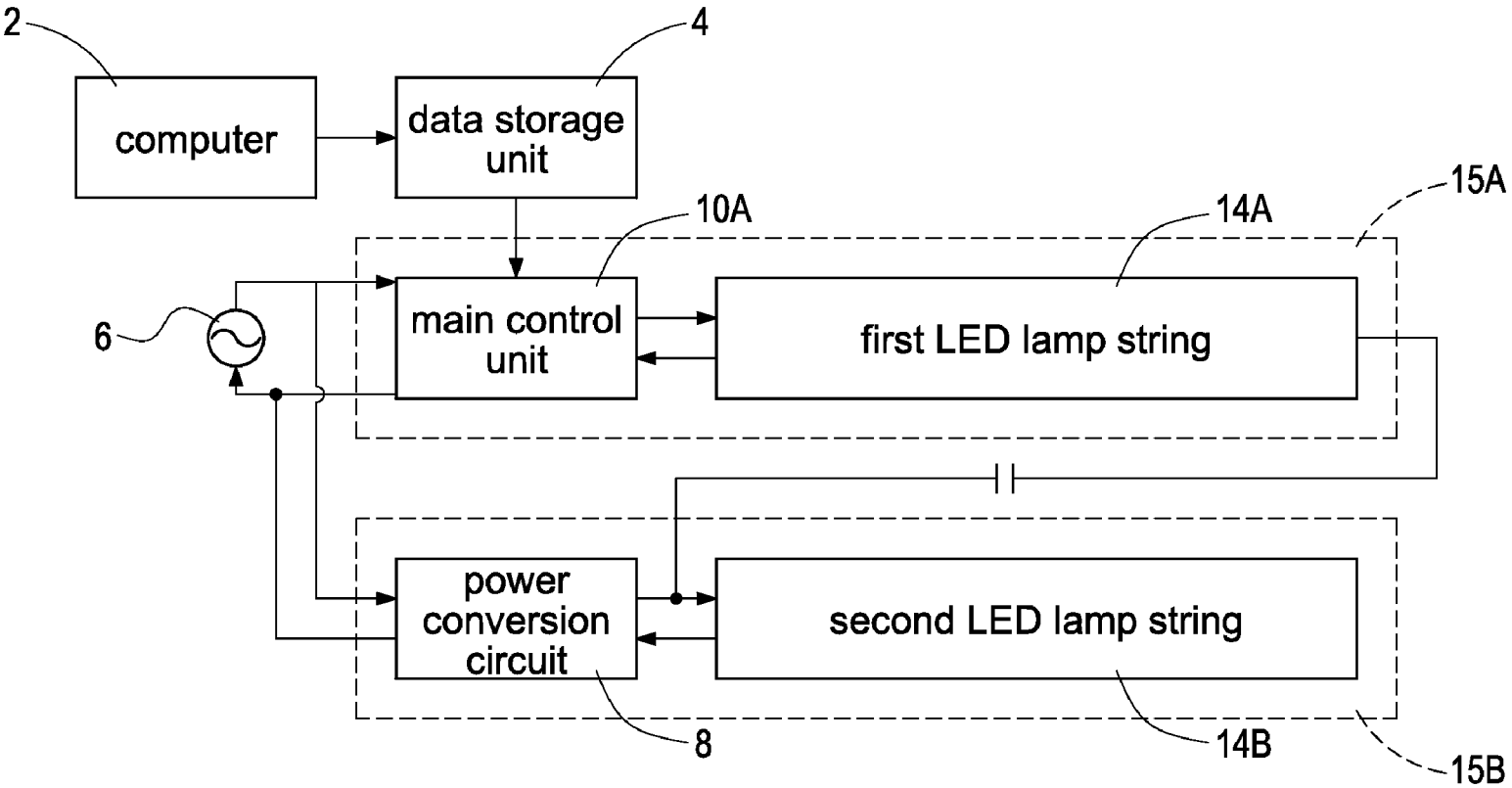
FIG. 7 is a block diagram of another embodiment of the LED control system using a modulated signal.

Reference is made to FIG. 7 which is a block diagram of another embodiment of the LED control system using a modulated signal. The above-mentioned power conversion circuit 8 and the control circuit 10 can be integrated into a main control unit 10A. A first LED lamp string apparatus 15A includes the control unit 10A and a first LED lamp string 14A. A second LED lamp string apparatus 15B includes the power conversion circuit 8 and a second LED lamp string 14B. The main control unit 10A generates a modulated signal, and the modulated signal can be sent to the first LED lamp string 14A and the second LED lamp string 14B. The power conversion circuit 8 provides the required power to the second LED lamp string 14B. Accordingly, more LEDs can be simultaneously controlled. It assumes that a voltage drop across each of the LED emission circuits is 4 volts. Hence, there are about 27 (≈110÷4) LED emission circuits can be driven and controlled (in the embodiment as shown in FIG. 1); there are about 54 (≈110÷4×2) LED emission circuits can be driven and controlled (in the embodiment as shown in FIG. 7).

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An LED control system using a modulated signal provided to store a computer control data in a data storage unit, and the data storage unit outputting a data signal to control the color and intensity of the LEDs, the LED control system comprising:

a power conversion circuit converting an AC power into a DC power;

a control circuit electrically connected to the power conversion circuit to receive the DC power outputted from the power conversion circuit and the data signal outputted from the data storage unit, and to modulate the data signal to a modulated signal; and a plurality of LED emission circuits electrically connected in series to the control circuit through a transmission line to receive the DC power outputted from the control circuit and the modulated signal to vary the color and intensity of the LEDs, wherein the LED emission circuit comprises:

a voltage regulator unit electrically connected to the control circuit to receive an output voltage outputted from the control circuit and regulate the output voltage to a specific voltage to supply the required power to other units;

a signal acquisition unit electrically connected to the voltage regulator unit to block the DC power and pass only the modulated signal;

an amplifier unit electrically connected to the signal acquisition unit to amplify the modulated signal outputted from the signal acquisition unit and receive the required power supplied by the voltage regulator unit;

a demodulation unit electrically connected to the amplifier to demodulate the amplified modulated signal and receive the required power supplied by the voltage regulator unit;

a filter unit electrically connected to the demodulation unit to reconstruct the demodulated signal outputted from the demodulation unit and receive the required power supplied by the voltage regulator unit;

a recognition and logic controller unit electrically connected to the filter unit to recognize the data contents of the reconstructed signal outputted from the filter unit and receive the required power supplied by the voltage regulator unit;

a counter and shift register unit electrically connected to the recognition and logic controller unit to receive the data sent from the recognition and logic controller unit, and the data outputted when a defaulted end signal received; and receive the required power supplied by the voltage regulator unit;

an encoder unit electrically connected to the voltage regulator unit;

a second modulation unit electrically connected to the encoder unit to modulate the signal outputted from the encoder unit and receive the required power supplied by the voltage regulator unit;

a latch unit electrically connected to the counter and shift register unit to receive and latch the data outputted from the counter and shift register unit and receive the required power supplied by the voltage regulator unit;

an output temporary storage unit electrically connected to the latch unit to temporarily store the data outputted from the latch unit and receive the required power supplied by the voltage regulator unit;

a plurality of constant current sources electrically connected to the output temporary storage unit to provide constant current sources and receive the data contents outputted from the output temporary storage unit;

a plurality of LEDs electrically connected to the constant current sources to receive the data contents outputted from the constant current sources, and receive the constant current sources to be driven to vary the color and intensity according to the data contents; and an address register unit is electrically connected to the recognition and logic controller unit.

2. The LED control system in claim 1, wherein the power conversion circuit converts a 110-volt AC power into a 110-volt DC power.

3. The LED control system in claim 1, wherein the control circuit comprises:

a voltage stabilizer unit electrically connected to the power conversion circuit;

a microcontroller unit electrically connected to the power conversion circuit to receive the data signal outputted from the data storage unit; and a first modulation unit electrically connected to the power conversion circuit, the microcontroller unit, and the voltage stabilizer unit, respectively.

4. The LED control system in claim 1, wherein the signal acquisition unit is a capacitor.

5. The LED control system in claim 1, wherein the LEDs include a red light LED, a green light LED, and a blue light LED.

6. An LED control system using a modulated signal provided to store a computer control data in a data storage unit, and the data storage unit outputting a data signal to control a first LED lamp string, and the first LED lamp string comprising:

a main control unit converting an AC power into a DC power, and outputting a modulated signal; and a plurality of LED emission circuits electrically connected in series to the main control unit through a transmission line to receive the DC power outputted from the main control unit and the modulated signal, and the modulated signal outputted to a second LED lamp string, wherein the LED emission circuit comprises:

a voltage regulator unit is electrically connected to the control circuit to receive an output voltage outputted from the control circuit and regulate the output voltage to a specific voltage to supply the required power to other units;

a signal acquisition unit electrically connected to the voltage regulator unit to block the DC power and pass only the modulated signal;

an amplifier unit electrically connected to the signal acquisition unit to amplify the modulated signal outputted from the signal acquisition unit and receive the required power supplied by the voltage regulator unit;

a demodulation unit electrically connected to the amplifier to demodulate the amplified modulated signal and receive the required power supplied by the voltage regulator unit;

a filter unit electrically connected to the demodulation unit to reconstruct the demodulated signal outputted from the demodulation unit and receive the required power supplied by the voltage regulator unit;

a recognition and logic controller unit electrically connected to the filter unit to recognize the data contents of the reconstructed signal outputted from the filter unit and receive the required power supplied by the voltage regulator unit;

a counter and shift register unit electrically connected to the recognition and logic controller unit to receive the data sent from the recognition and logic controller unit, and the data outputted when a defaulted end signal received; and receive the required power supplied by the voltage regulator unit;

an encoder unit electrically connected to the voltage regulator unit;

a second modulation unit electrically connected to the encoder unit to modulate the encoded signal outputted from the encoder unit and receive the required power supplied by the voltage regulator unit;

a latch unit electrically connected to the counter and shift register unit to receive and latch the data outputted from the counter and shift register unit and receive the required power supplied by the voltage regulator unit;

an output temporary storage unit electrically connected to the latch unit to temporarily store the data outputted from the latch unit and receive the required power supplied by the voltage regulator unit;

a plurality of constant current sources electrically connected to the output temporary storage unit to provide constant current sources and receive the data contents outputted from the output temporary storage unit;

a plurality of LEDs electrically connected to the constant current sources to receive the data contents outputted from the constant current sources, and receive the constant current sources to be driven to vary the color and intensity according to the data contents; and an address register unit electrically connected to the recognition and logic controller unit.

7. The LED control system in claim 6, wherein the main control unit is composed of a power conversion circuit and a control circuit, and the control circuit comprises:

a voltage stabilizer unit electrically connected to the power conversion circuit;

a microcontroller unit electrically connected to the power conversion circuit to receive the data signal outputted from the data storage unit; and a first modulation unit electrically connected to the power conversion circuit, the microcontroller unit, and the voltage stabilizer unit, respectively.

8. The LED control system in claim 7, wherein the first modulation unit receives the data signal outputted from the microcontroller unit and to modulate the data signal to generate the modulated signal.

* * * * *